US006058990A

United States Patent [19]

Kent

[11] Patent Number: 6,058,990

[45] Date of Patent: May 9, 2000

[54] MULTI-FUNCTIONAL WORKTABLE SYSTEMS

[76] Inventor: Frank Michael John Kent, 12 Florian Road, London, United Kingdom, SW15 2NL

[21] Appl. No.: 09/043,809

[22] PCT Filed: Sep. 24, 1996

[86] PCT No.: PCT/GB96/02339

§ 371 Date: Mar. 25, 1998

§ 102(e) Date: Mar. 25, 1998

[87] PCT Pub. No.: WO97/11820

PCT Pub. Date: Apr. 3, 1997

[30] Foreign Application Priority Data

| | | | |
|---|---|---|---|
| Sep. 25, 1995 | [GB] | United Kingdom | 9519506 |
| Oct. 4, 1995 | [GB] | United Kingdom | 9520277 |
| Nov. 8, 1995 | [GB] | United Kingdom | 9522934 |
| Feb. 28, 1996 | [GB] | United Kingdom | 9604249 |
| Apr. 1, 1996 | [GB] | United Kingdom | 9606895 |
| Jul. 1, 1996 | [GB] | United Kingdom | 9613742 |
| Aug. 13, 1996 | [GB] | United Kingdom | 9616962 |

[51] Int. Cl.[7] ..... B25H 1/00

[52] U.S. Cl. ..... 144/286.5; 144/1.1; 144/286.1; 83/574; 83/468; 83/468.3; 269/139; 269/901

[58] Field of Search ..... 144/1.1, 286.1, 144/286.5, 287; 269/901, 139, 152, 164, 212, 244, 900; 83/574, 471.3, 468, 468.2, 468.3; 108/121–123, 131

[56] References Cited

U.S. PATENT DOCUMENTS

| | | | |
|---|---|---|---|
| 4,073,484 | 2/1978 | Beekenkamp | 144/286.1 |
| 4,415,149 | 11/1983 | Rees | 269/901 |
| 4,527,786 | 7/1985 | Hsu | 269/901 |
| 4,562,670 | 1/1986 | Maier et al. | 51/166 |
| 4,647,028 | 3/1987 | Yang | 269/139 |
| 4,909,491 | 3/1990 | Cheng | 269/901 |
| 5,074,503 | 12/1991 | McDonald et al. | 248/167 |
| 5,165,317 | 11/1992 | Findlay | 83/574 |
| 5,383,977 | 1/1995 | Pearce | 144/286.5 |
| 5,579,672 | 12/1996 | Findlay | 83/467 |
| 5,681,034 | 10/1997 | Noniewicz | 269/139 |

FOREIGN PATENT DOCUMENTS

| | | |
|---|---|---|
| 684112 | 11/1995 | European Pat. Off. . |
| 2286144 | 9/1995 | United Kingdom . |
| 93/18894 | 9/1993 | WIPO . |
| 95/17283 | 6/1995 | WIPO . |

*Primary Examiner*—W. Donald Bray
*Attorney, Agent, or Firm*—Ratner & Prestia

[57] ABSTRACT

A worktable has a supporting structure comprising folding elements (2, 3 and 4), and a top frame (1) along which worktop sections (5) may be selectively positioned to function as the jaws of a clamp or to function in conjunction with power tool support elements, here exampled as a sliding plate (6) for the attachment of a circular saw and a fence guide(7).

22 Claims, 16 Drawing Sheets

Fig. 10
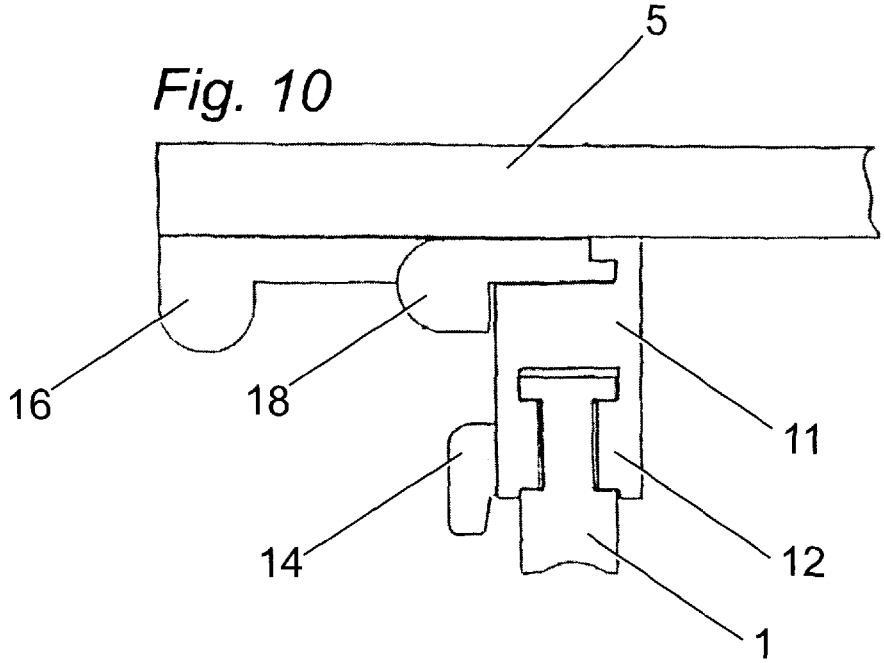
Fig. 11
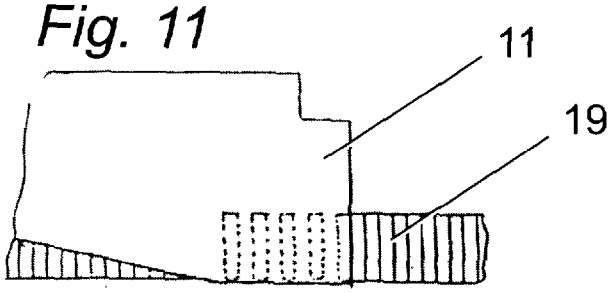
Fig. 12
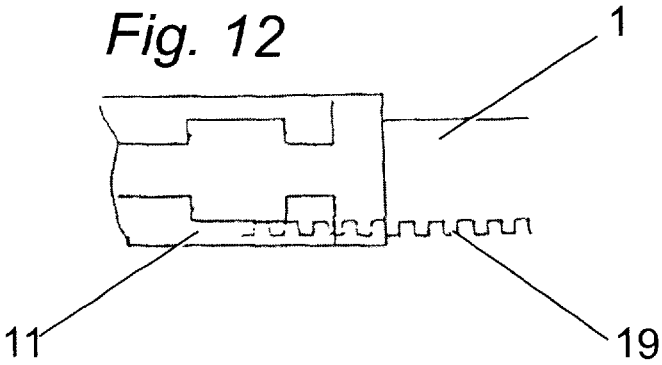
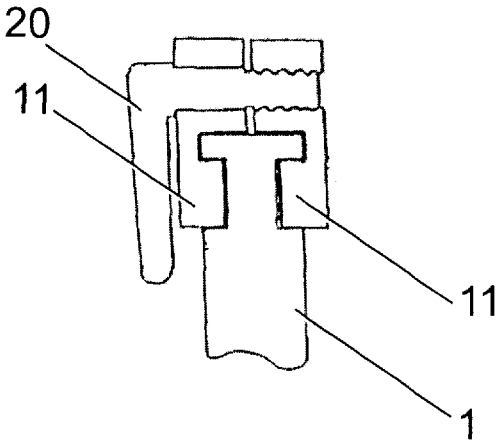
Fig. 13

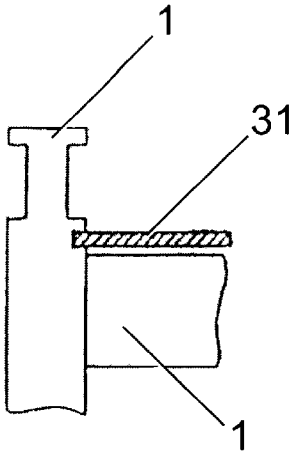
Fig. 25
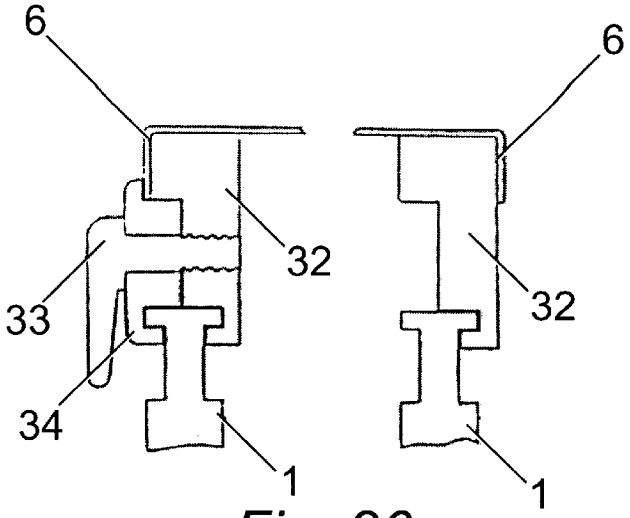
Fig. 26
Fig. 27
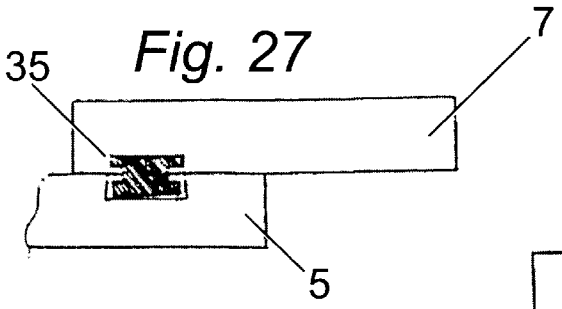
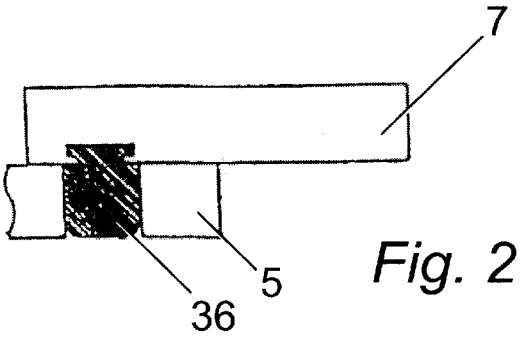
Fig. 28
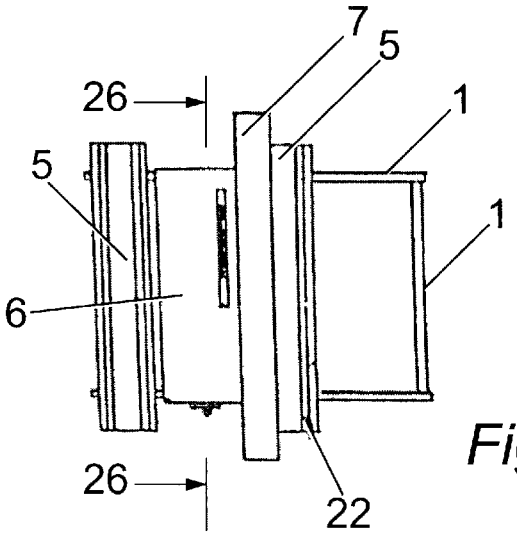
Fig. 29

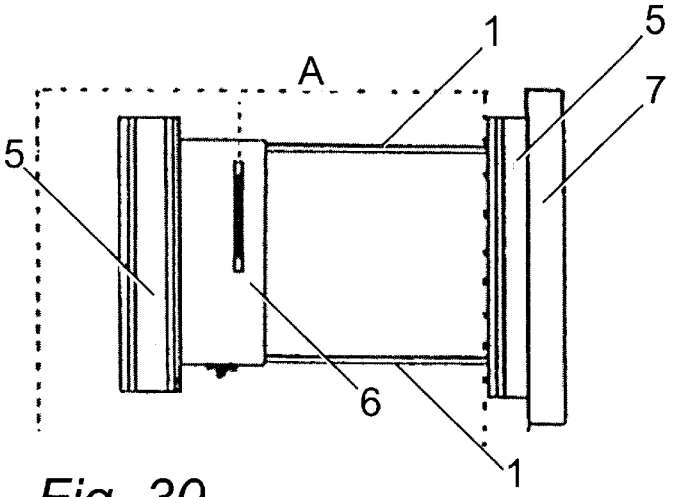
Fig. 30
Fig. 31
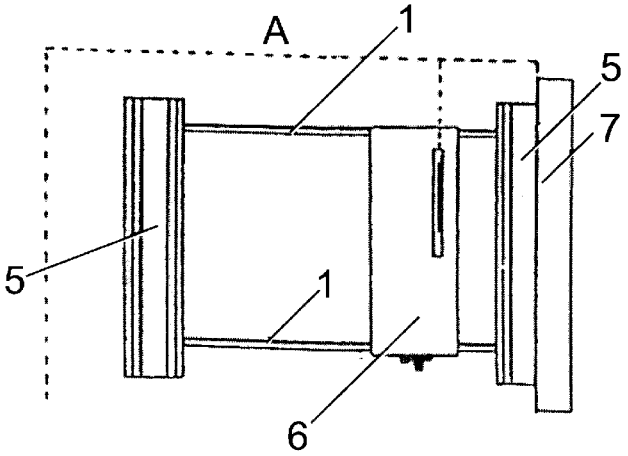
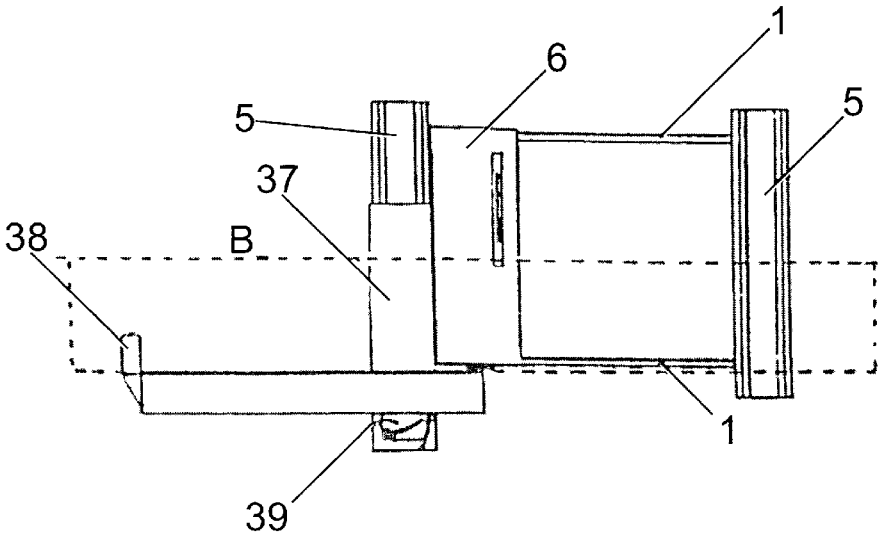
Fig. 32

MULTI-FUNCTIONAL WORKTABLE SYSTEMS

This invention relates to worktable systems of multi-functional use in connection with building work, carpentry and the like.

Known, easily transportable systems for the clamping and handling of workpieces and/or the support or guidance of power tools are limited in their capacity to deal with larger work material. They are also limited in their versatility; clamping tables do not provide adequate saw table functions, saw tables do not provide adequate clamping table functions and neither provide drill table functions.

In general terms the present invention addresses itself to providing an integrated system in which the worktable is a clamping table and/or a saw table and/or a drill table for example, in which the capacity to handle larger material in all the mentioned functions is more than double that of known systems and in which for easy carrying and transport the folding system is more compact than that of known apparatus.

According to the present invention there is provided a worktable system comprising a supporting structure and two or more sections of planar worktop, two of which may serve as the jaws of a clamp, the said sections being unattached, directly or indirectly to any fixed point on the supporting structure such that in the terms of this invention they are "freely displaceable" along the length of the supporting structure and may be locked in any selected position along that length. The means of tightening forward one or both work top sections, in their function as the jaws of a clamp, is carried together with the displacement of the said sections and takes place from the selected locked position.

In the terms of this invention the "supporting structure" would normally comprise a top support with leg support structure but it could comprise of a top frame only.

Another aspect of the present invention provides a worktable system comprising a supporting structure and displaceable worktop sections in which one or more of the sections is provided with a channel or channels and elements for clamping, machining or other purposes which may be inserted into the said channels.

From another aspect the invention provides a worktable system comprising a supporting structure and displaceable worktop sections in which one or more of the sections may have attached to it power tools, this tool plate section being selectively placed and locked into position to provide with the other section or sections the most suitable support for a work piece, comprising also of elements associated with power tool operations which may use the other section or sections as a fixing point and/or guidance means.

From another aspect the invention provides a worktable system comprising a supporting structure and displaceable worktop sections and means for power tool guidance in the form of a straight edge which may be attached to one of the worktop sections and pivoted to any selected angle traversing the work piece, comprising also of means for aligning and clamping the work piece.

From another aspect the invention provides an articulated tool support and/or guidance system which attached to the supporting structure of the worktable may span the worktop sections or attached to a worktop section or sections may span a portion of their surface, the worktop sections supporting the work piece under the articulated tool support, comprising also of means for aligning and clamping the work piece.

From another aspect the invention provides a worktable system comprising a supporting structure, a worktop secured to it and a plurality of extension pieces releasably securable to said supporting structure, the proximal end being adjustably brought within the volume of the worktable, the distal end having a leg support, the said extension pieces being joined by a cross-member which supports the work piece.

From another aspect the invention provides a worktable system comprising a supporting structure and displaceable worktop sections in which the leg supports fold inward towards each other and in which the worktop sections may be removed from their operational position on the supporting structure to be packed away within or attached to the folded supporting structure.

Embodiments of the invention will now be described, by way of example only, with reference to the accompanying drawings, in which FIG. 1 is a side view of a worktable with two jaw and one tool plate section;

FIG. 10 is a right end view of FIG. 4;

FIG. 11 is a partial schematic side view of an alternative jaw positioner which may be lifted off and press fitted down onto vertical, square comb section;

FIG. 12 is a schematic plan view of FIG. 11;

FIG. 13 is a cross-section view of a split jaw positioner at the point where the two halves may be tightened onto the top frame;

FIG. 25 is a partial end view of a sliding top;

FIG. 26 is a partial cross-section on the line 26—26 of FIG. 29;

FIG. 27 is an end view of a fence guide fitted to a channel;

FIG. 28 is a cross section of hole fitting for fence guide;

FIG. 29 is a plan view of the fence guide set for narrow cut;

FIG. 30 is a plan view of the max. width of rip-cut;

FIG. 31 is a plan view of a narrow cut on a panel;

FIG. 32 is a plan view of work table set for cross-cut;

Figure 1:
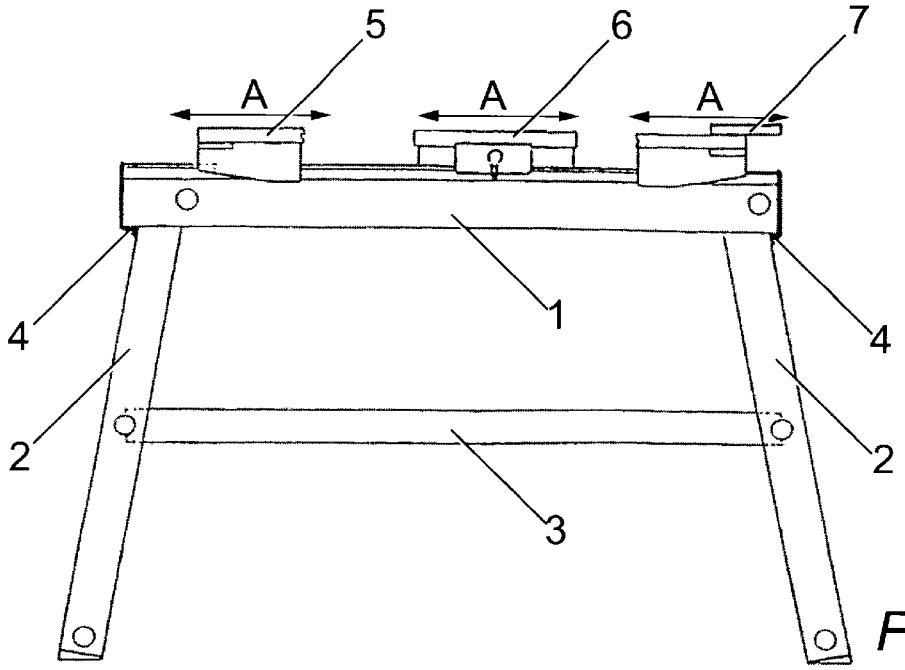

Referring to FIG. 1, in the prefered forms of the invention a worktable comprises a top frame 1 with inward folding leg supports 2 braced apart by removable struts 3 against blocking elements 4 and two or more freely displaceable work top sections 5 lockable in selected position along the top frame as indicated by arrows A, two of which 5 may function as the jaws of a clamp or in other functions. As shown here they function with a freely displaceable tool plate section 6 the two sections being selectively positioned in relation to the tool plate section to provide the most suitable support for a workpiece and/or as a fixing point for an element associated with a power tool operation, a fence guide 7 for example.

One suitable form of construction for the worktable is that employed in ladder fabrication: thus hollow section top frame and leg support lengths joined by hollow section cross-members may provide lightness and rigidity.

Figure 2:
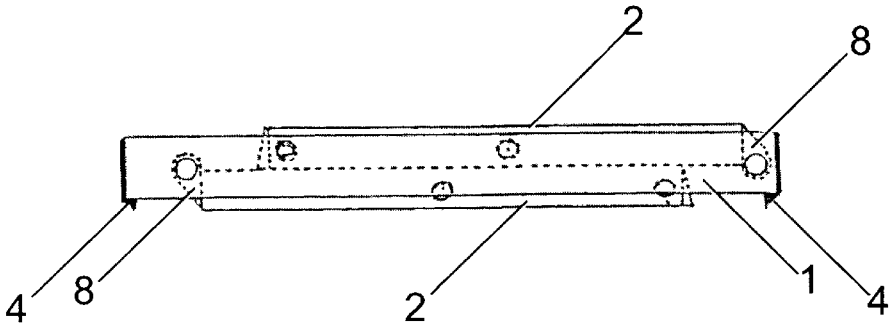
FIG. 2 is a schematic side view of the worktable in FIG. 1 folded.

In FIG. 2 the worktable structure of FIG. 1 is shown in folded position, the right hand leg support lying above the left hand leg support within the top frame, both leg supports having inserted dog-legged elements 8 which off-centre them from the top frame cross-members which serve as their axis points, this off-centring enabling them to nest one above the other while using axis points set at a common level.

The worktop sections are removable from their operational position across the length of the top frame and can be packed away in line with it either between the cross-members of the folded leg supports or attached to the outside of the folded structure.

Figure 3:
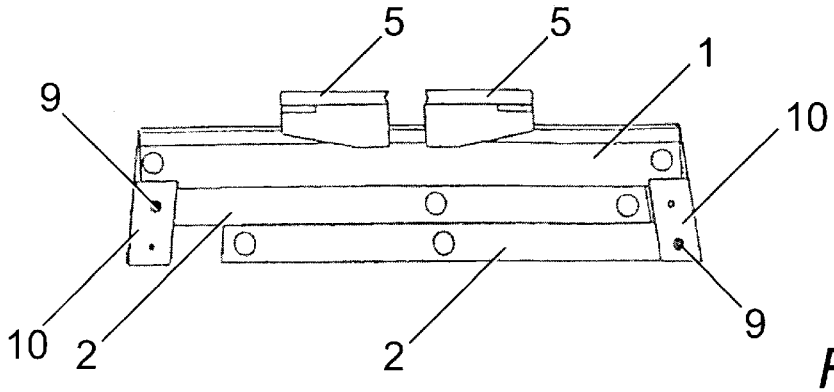
FIG. 3 is a side view of an alternative support structure in folded position with the jaws in operational position.

In FIG. 3 another inward folding leg support system is shown in folded position the leg supports lying above each other under the top frame, having axis points 9 set at different levels within open rectangle section leg brackets 10 attached to the top frame, the open inward facing side of the rectangle allowing the legs to fold inwards, the outer closed side being that which the leg supports are braced against when folded out.

The two worktop sections are shown in operational position on the top frame because with the leg supports fully folded the worktable provides an even level stable base for low level clamping, of a door set on edge for example.

Turning now to FIGS. 4 to 10 a detailed preferred embodiment for the displacement, locking and tightening forward of the work top sections will now be described. There are five principle elements: the worktop section itself 5, the jaw mount 15 to which it is attached, the jaw positioner 11 which carries the jaw mount and locks into position on the top frame, the suitable form of the top frame, in this example a channel 13 and the jaw tightener 16 which may push the jaw mount forward.

Figure 7:
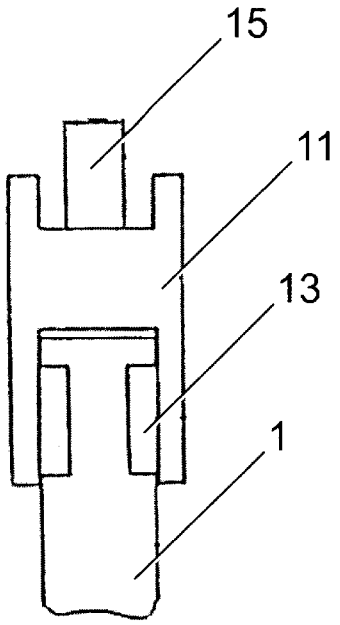
FIG. 7 is a cross-section on the line 7—7 of FIG. 4.
Figure 8:
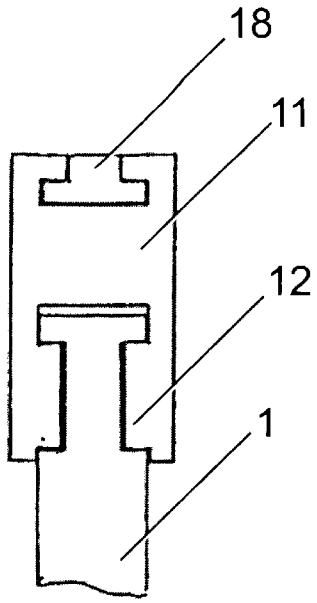
FIG. 8 is a cross-section on the line 8—8 of FIG. 4.

Starting with the jaw positioner we see from FIGS. 5–8 that it straddles the top frame, the upper part of its body lying above but not on the top frame, with downward projections on each side of the top frame to the inside of which is fitted a male pivot-block element 12, a square with two of the opposite diagonal corners rounded, this element fitting precisely into the top frame channel as shown in cross-section view FIG. 8, the weight of the whole jaw system being carried by these male pivot-blocks.

The jaw positioner may be tilted slightly forward pivoting on the forward rounded corner of the male pivot-block and in this slightly inclined plane it may be slid along the top frame channel, being locked in position when returned to the horizontal plane by the squre corners of the male pivot-block pressing against the upper and lower edges of the top frame channel, any further backward pressure on the jaws in their clamping action only increasing the blocking force as it does with the female pivot element on a conventional bar clamp.

A lock element 14 comprises a lever on the outside of the downward projections connected to a cam-form on the inside which when turned presses against the upper edge of the top frame channel to lock the jaw positioner in position when there is an absence of a clamping force to so do.

Figure 4:
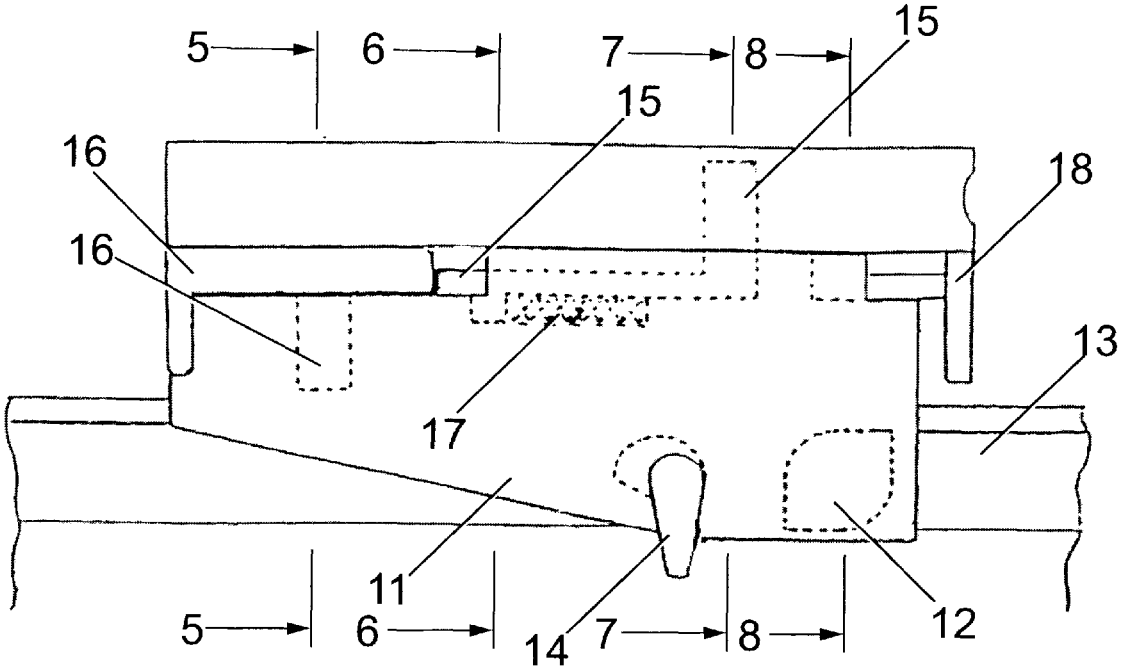
FIG. 4 is a schematic side view of the preferred embodiment for jaw positioner, jaw mount, jaw tightener and jaw.
Figure 5:
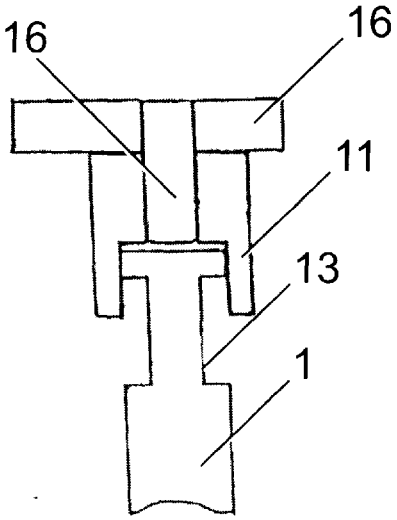
FIG. 5 is a cross-section on the line 5—5 of FIG. 4.
Figure 6:
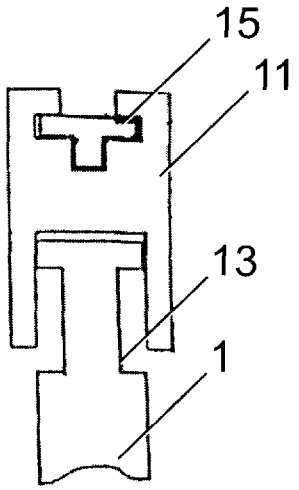
FIG. 6 is a cross-section on the line 6—6 of FIG. 4.
Figure 9:
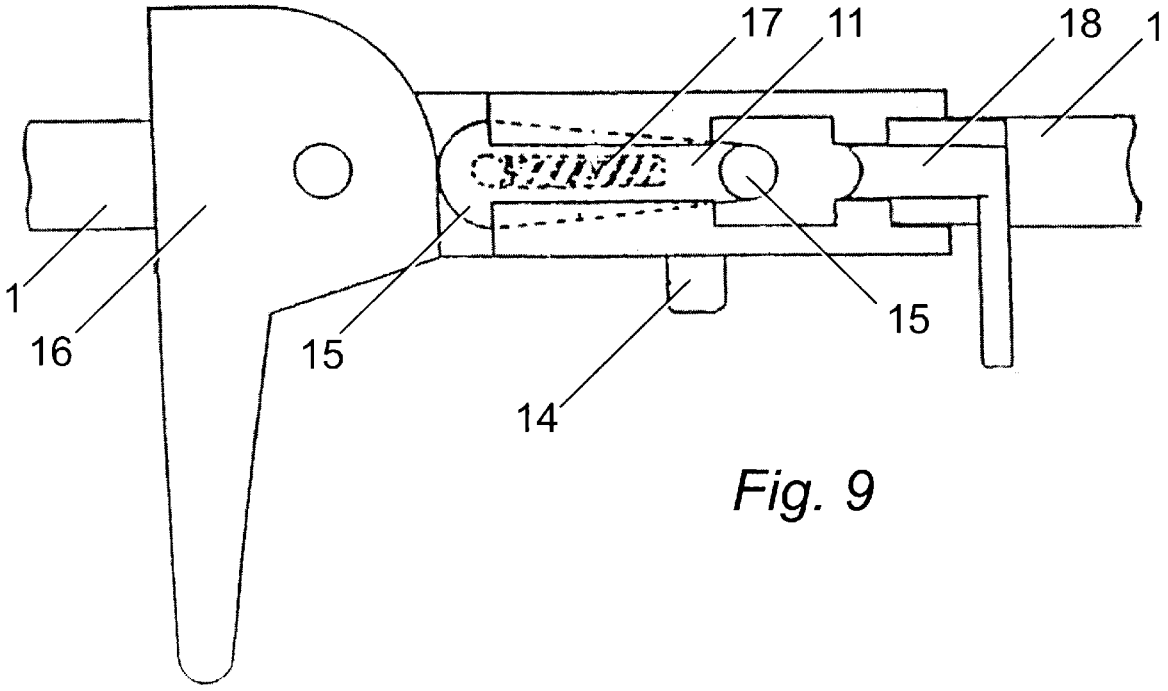
FIG. 9 is a schematic plan view of FIG. 4 with the jaws removed.

Turning now to the jaw mount we can see from FIGS. 4, 7 and 9 that it comprises at its forward end of an upward cylindrical projection which inserts into the jaw and permits partial rotation of the jaw around it, a flat body which may slide in the T-slot channel of the jaw positioner, the said body tapered inwards at its forward end to permit sideways movement within the channel, broadening out at its rear end to precisely match the width of the T channel. A downward projection from the jaw mount engages with a return spring 17 set in the body of the jaw positioner, the said spring keeping the jaw mount pushed against the jaw tightener.

Sideways movement of the forward end of the jaw mount and turning movement of the jaw around the jaw mount permit the jaws to function in an angled position but equally permits an easy sliding movement in which one side of the worktop section may be moved forward or backward at a different rate to the other side thus avoiding any of the blocking malfunction that can occur in simple sliding systems.

The jaw tightener comprises an eccentric circle or cam-form arrangement with an axis point set in the body of the jaw positioner and a lever handle extending outwards just under the jaw. When the lever is pulled backwards the jaw mount is pushed forward, only limited movement forward being required as the jaw may already be positioned in contact with the workpiece.

A jaw mount block situated in the front end of the T-channel of the jaw positioner may be slid backwards to engage with the front end of the jaw mount preventing lateral movement at this end.

FIGS. 11 to 16 show alternative embodiments for the jaw positioner. In FIGS. 11 and 12 for example there is shown a jaw positioner which may be lifted vertically off a square comb section 19 which may run the length of the supporting structure and then may be repositioned, square comb section on the interior of the downward projections of the jaw positioner interlocking with the square section on the top frame.

In FIG. 13 there is shown a cross-section of a jaw positioner at a point where a threaded element 20 may tighten together two split ends of the jaw positioner locking it onto the top frame.

Figure 14:
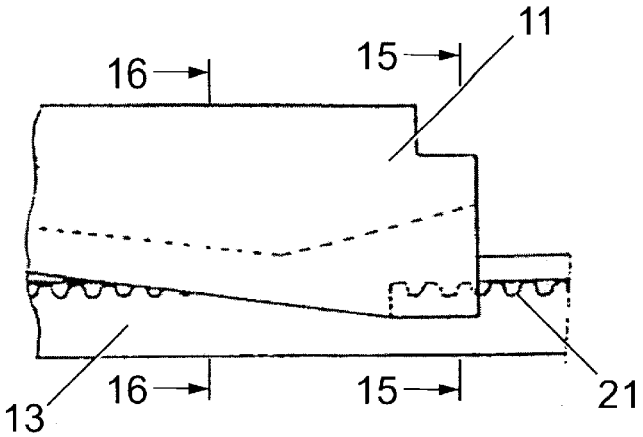
FIG. 14 is a partial schematic side view of a jaw positioner which may pivot on the top frame.
Figure 15:
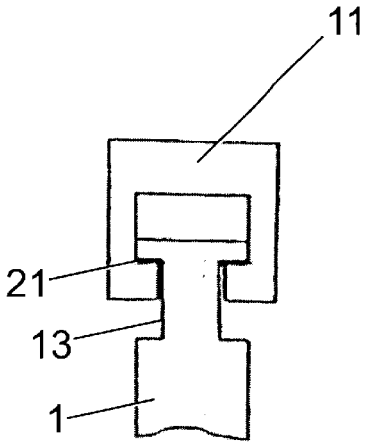
FIG. 15 is a cross-section on the line 15—15 of FIG. 14.
Figure 16:
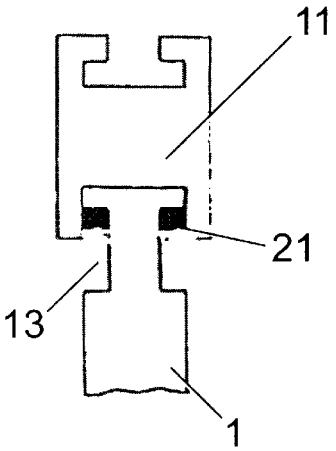
FIG. 16 is a cross-section on the line 16—16 of FIG. 14.

In FIGS. 14 to 16 there is shown a jaw positioner wherein the body is supported by the top frame at a pivot point, tilting forward about this point disengages cogged section set on the inside of the downward projections from cogged track 21 on the top frame, the positioner being displaceable along the top frame by sliding in an inclined plane and lockable in selected position when returned to the horizontal plane.

The invention also provides that the jaw positioner may enclose around or partially enclose around a supporting structure, for example in the form of a bar or tube using the female pivot blocking principle employed in conventional bar clamps.

The general provisions of the invention do not exclude other ways in which worktop sections usable as jaws may be given the means to be freely displaceable along the length of a supporting structure and lockable in selected position. While termed the jaw positioner the system may equally apply to worktop sections which do not have a jaw functioning capacity.

The conventional worktop section usable as the jaws of a clamp employs holes in which inserts may be placed permitting jaw clamping on the surface of the jaws as well as between the front edges. FIGS. 17 to 24 show an alternative system of attachment and attachable elements.

Figure 17:
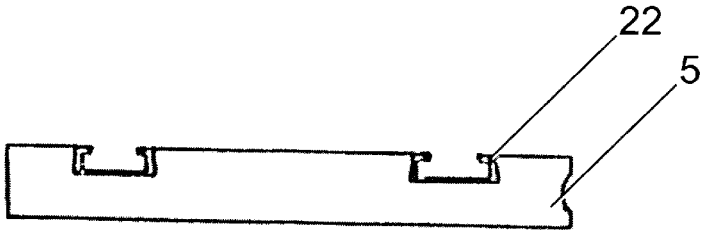
FIG. 17 is an end view of a top section with channel inserts.

In FIG. 17 there is shown a worktop section usable as a jaw with channels in its upper surface. The channels may be formed in the main body material of the jaw and/or they may be additions to it as for example in the embodiment shown in FIG. 22 where channel inserts in extruded aluminium are set into a dove-tailed channel in the wood of the jaw.

Figure 18:
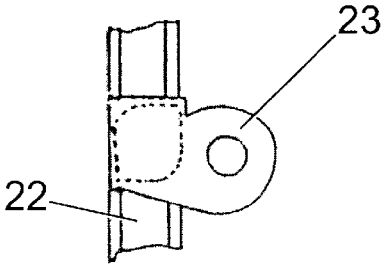
FIG. 18 is a schematic plan view of a clamp positioner element fitted into a channel.
Figure 19:
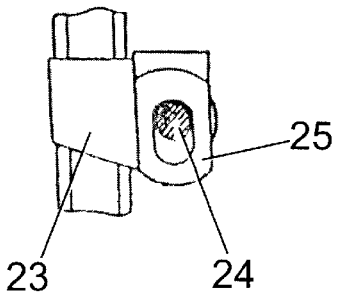
FIG. 19 is a plan view of FIG. 18 with axis rod and clamp piston added.
Figure 20:
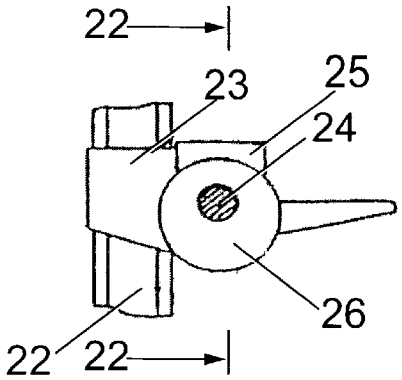
FIG. 20 is a plan view of FIG. 19 with cam-form clamp tightener.
Figure 21:
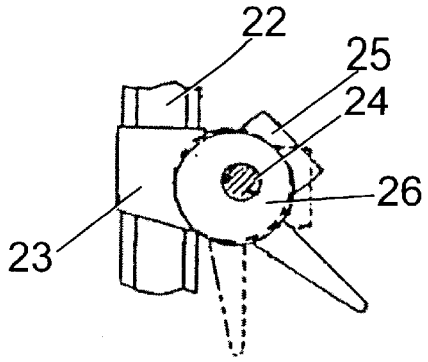
FIG. 21 is a schematic plan view of FIG. 20 illustrating angled positions for the clamp.
Figure 22:
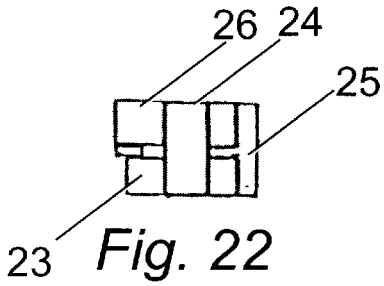
FIG. 22 is a cross-section on the line 22—22 of FIG. 20.

In FIGS. 18 to 20 there is shown a part by part build up of a clamping element, first the clamp positioner 23 with a male pivot block portion in the channel and a portion above which disposes a hole for an axis, secondly the axis point 24 and a clamp piston 25 with slot permitting forward and backward movement and turning around said axis and finally a cam-form element 26 with lever handle which may push the piston forward. The clamp may be positioned anywhere along the channel in contact with the workpiece before being tightened to provide independent clamping on the surface of the jaws which does not require tightening of the jaw. The line of clamping action may be in line with the length of the jaw as shown in FIG. 20 or set at an angle to it as shown in FIG. 21.

Figure 23:
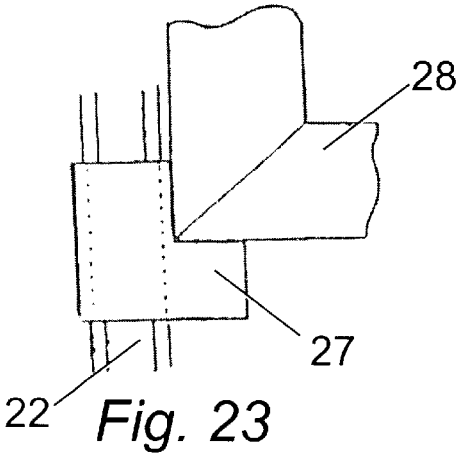
FIG. 23 is a plan view of a corner clamp element.

In FIG. 23 there is shown a clamping element 27 comprising a portion which slides in the channel and a portion which in "l" form lies above, the said clamp being selectively positioned along the jaw to follow and clamp the corner form of a workpiece, for example a mitred corner joint the two parts of which may be held when the jaw is tightened.

Figure 24:
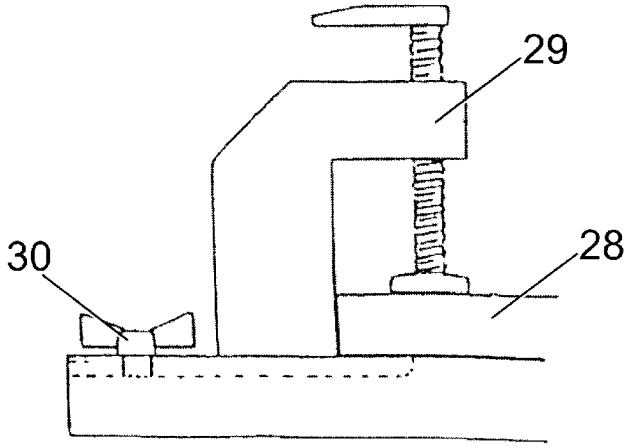
FIG. 24 is a schematic side view of a vertical clamp.

In FIG. 24 there is shown a clamp element 29 comprising a portion which slides in the channel and a portion which disposes a vertical clamping action, the said element being selectively positioned anywhere along the length of the jaws and lockable in position by means of a tightening thread 30. The vertical clamp element may provide in addition to clamping the means of aligning a workpiece on the worktops.

The general provisions of the invention do not exclude other means of providing lengths along which a clamp element may be selectively positioned, for example a rail element added to conventional jaws where holes normaly serve as the only insert points.

In FIG. 25 there is shown a freely displaceable worktop 31 which supported on both sides by the top frame may slide at a height below that of the jaw sections providing support for a workpiece being clamped between the jaws and/or as an additional work surface and/or as the lid for a storage unit giving vertical access to that unit.

In the invention as so far described by the drawings the freely displaceable worktop sections have been presented primarily in their jaw functioning aspect. FIGS. 26–34 describe them in another aspect in which they function with another worktop section.

In FIG. 26 there is a partial cross-section view along the line 26—26 in FIG. 29 of a tool plate worktop section mounted at either side of the worktable on support elements 32 which may slide along the top frame, the said tool plate section being lockable in selected position by means of a lever and threaded element 33 mounted in a further sliding element 34 the said threaded element tightening the two sliding elements together onto the top frame. The tool plate section may equally be displaced and locked in position by a jaw positioner type element.

The tool plate work top section may have attached to its upper or under surface by known conventional means power tools. In the embodiments shown the example that is given is the attachment of a circular saw to the underside of the tool plate and the related function of the other worktop sections to this particular power tool but the general provisions of the invention do not exclude the mounting of other power tools nor the use of other elements associated with the particular power tool.

In FIG. 27 there is shown the mounting of a fence-guide to a channel in a worktop section, element 35 set in a channel on the underside of the fence guide 7 is slid into the worktop channel. FIG. 28 shows that an appropriately shaped element 36 may also attach a fence guide to a worktop with hole fitting points.

Tool plates which can be displaced by sliding are well known, normally carrying a power tool on their upper surface, for example a circular saw, along the length of the supporting structure across a workpiece positioned below, machining that workpiece along a line parallel to the displacement of the said tool plate.

The system of tool plate displacement illustrated by way of example in FIGS. 29–31 is altogether different: the tool plate is displaced and locked in a position selected to give the most appropriate support for and alignment with a workpiece which is then fed on to the power tool, being machined in a line perpendicular to the line of displacement of the tool plate.

In FIG. 29 the worktable is set up for a narrow width of rip-cut, the fence guide being fixed in the forward channel of a worktop section. In FIG. 30 the worktable is set up for the maximum width of rip-cut on a standard 1250 mm wide panel, indicated by dotted line A, the fence guide being fixed in the rear channel of a worktop section which is set to the furthest end of the worktable, the tool plate section being set at the furthest opposite end of the worktable. In FIG. 31 the worktable is set up for a smaller width of cut on the same panel, the tool plate being positioned to the right so that the portion of the panel left of the saw blade remains more securely supported by the worktable.

On a conventional worktable where the saw blade is situated approximately in the middle, other things being equal the max. width of rip-cut is considerably below that of a displaceable system and equally the support for the portion of panel left of the saw blade is considerably less. The advantage of narrow displaceable worktop sections is that they leave space for the displacement of the tool plate section without reducing support for the workpiece.

Figure 33:
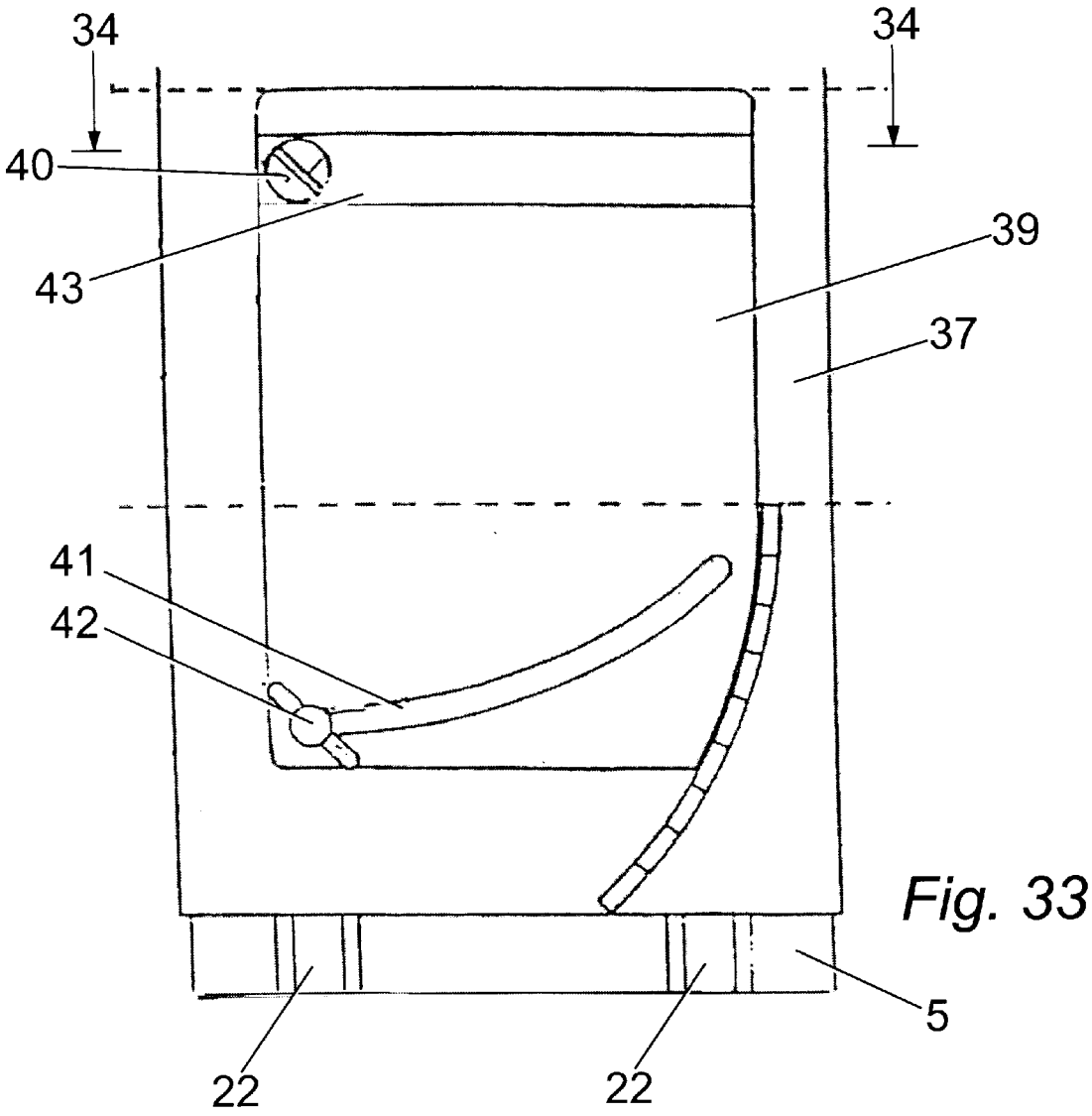
FIG. 33 is a plan view of the angle plate.
Figure 34:
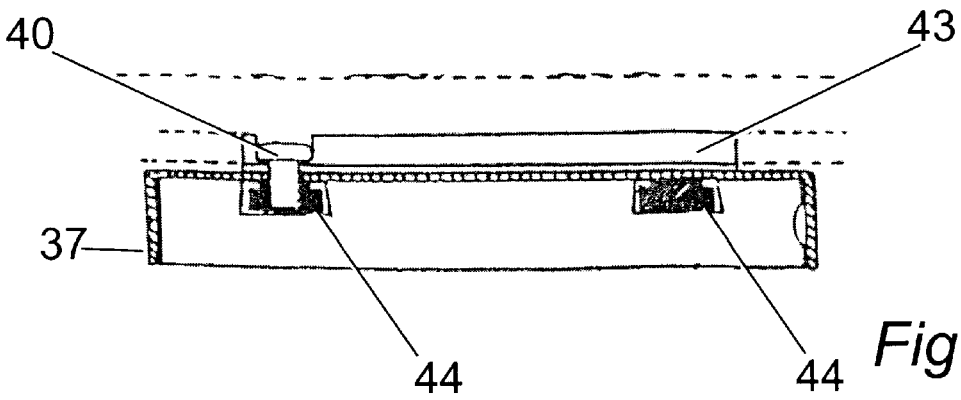
FIG. 34 is a cross-section on the line 34—34 of FIG. 33.

In FIGS. 32–34 there is shown a sliding table 37 which may feed a workpiece, indicated by dotted line R, onto the sawblade for cross or angled cuts, the sliding table using the channels and/or the edges of the worktop section as guidance means. A plate 39 attached to the sliding table at a pivot point 40 is shown in FIG. 33 set up for a cross-cut of 90 degrees but may be turned clockwise, a curved slot 41 running under a tightening element 42 which may lock the plate at a selected angle. A raised portion 43 may be fitted into the channel of the fence guide 7 which is mounted in the position indicated by dotted lines C in FIGS. 33 and 34. A support plate element 38 may be fitted to the end of element 7 for the support of long workpieces. Runners 44 attached to the underside of the sliding table may slide in the channels of the worktop section.

FIGS. 35–39 illustrate another aspect of the invention in which the worktop sections may provide the fixing means for straight edge guidance of a power tool across a workpiece and support, alignment and clamping of that workpiece.

Figure 35:
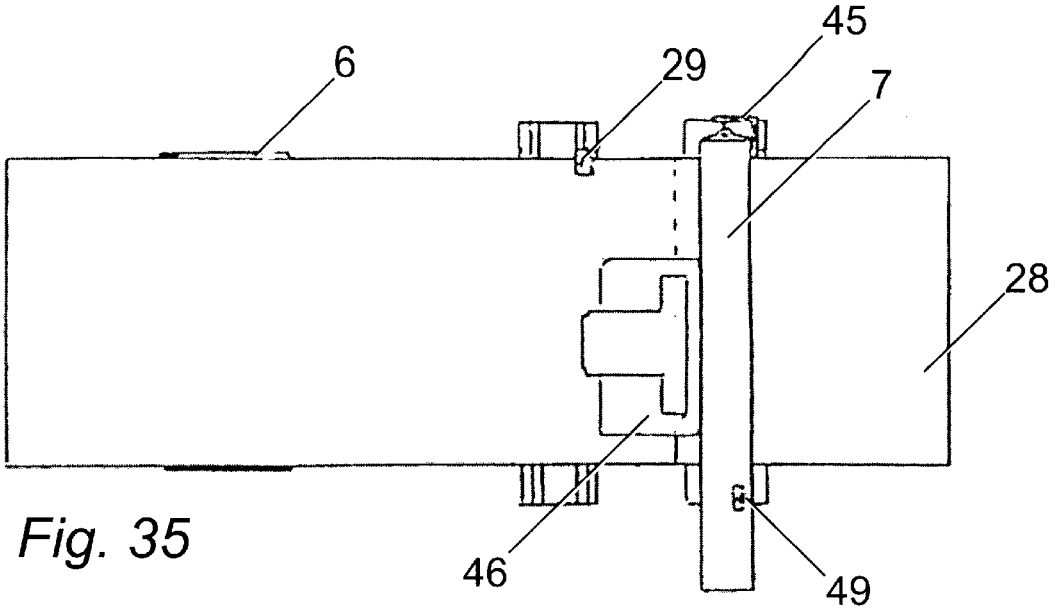
FIG. 35 is a schematic plan view of the straight edge guide function.
Figure 36:
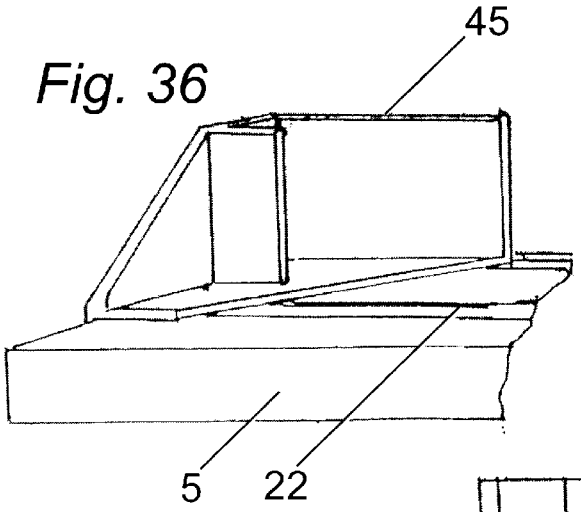
FIG. 36 is an illustration of an element for attaching straight edge guide.
Figure 37:
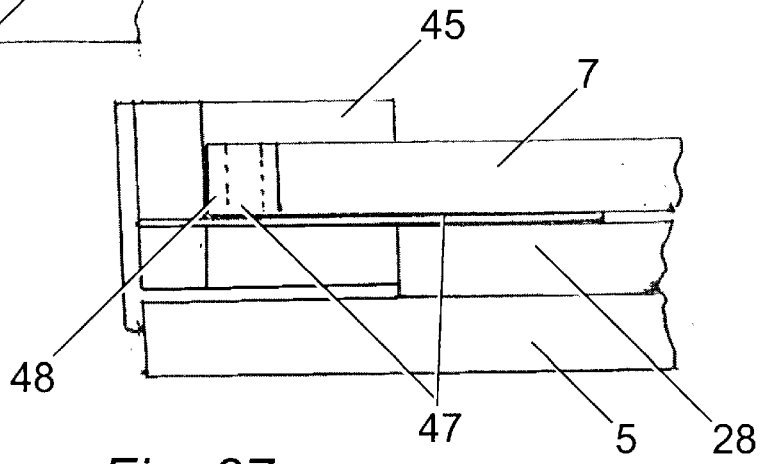
FIG. 37 is a schematic side view of the straight edge guide and angle plate engaged with attachment element.
Figure 38:
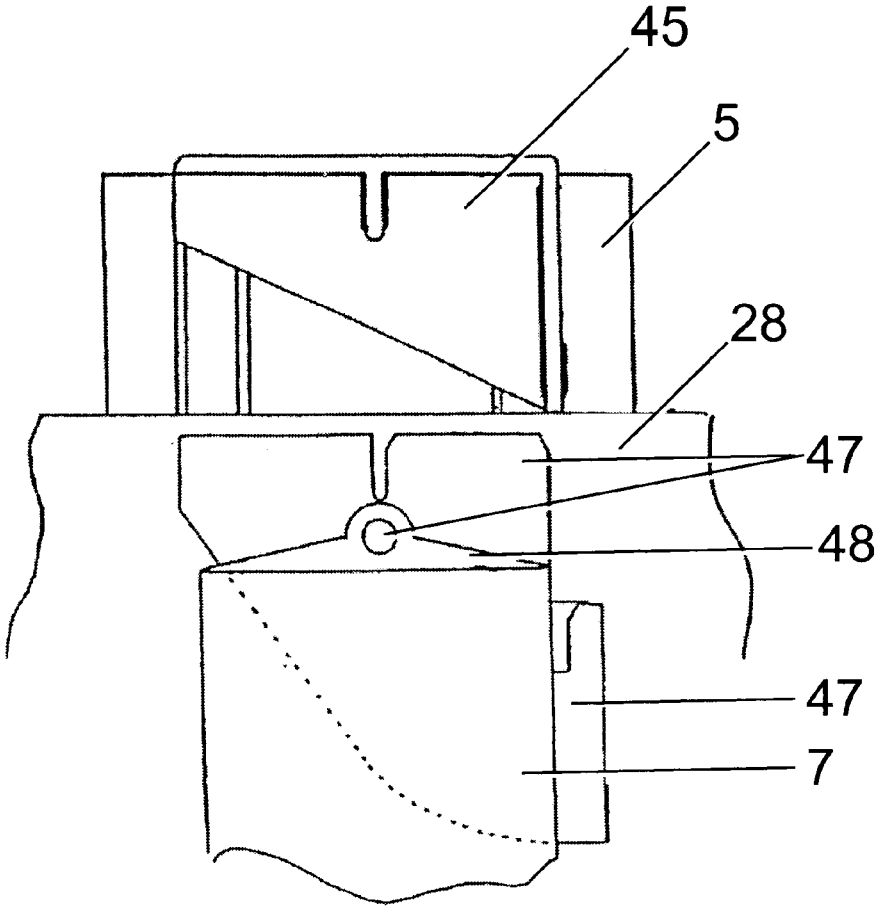
FIG. 38 is a schematic plan view of straight edge guide and angle plate before engagement with the attachment element.
Figure 39:
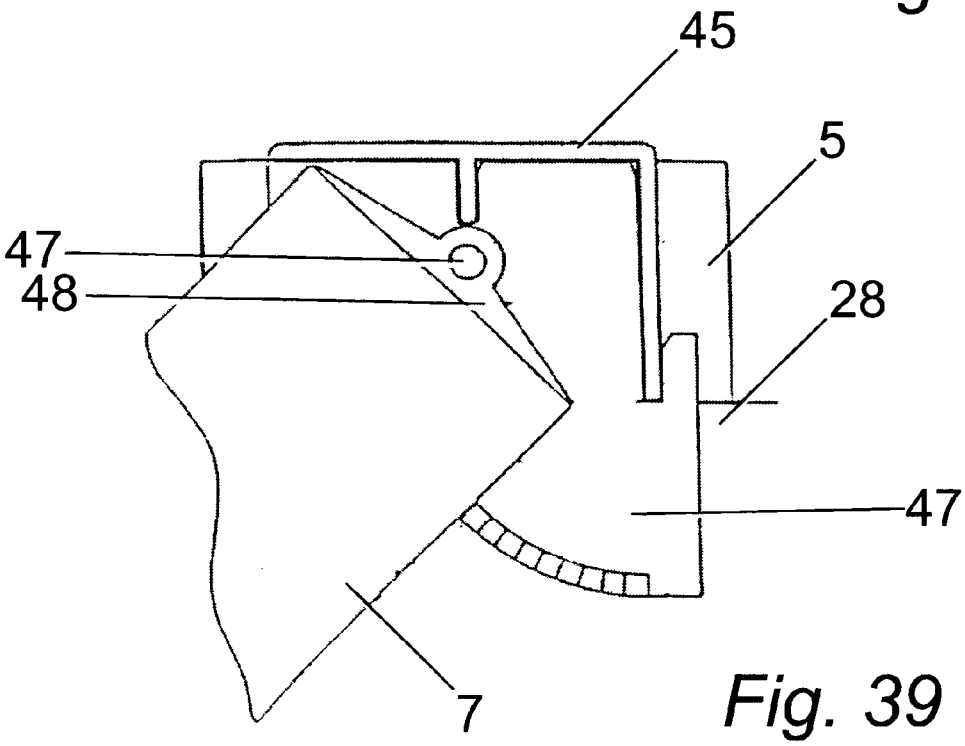
FIG. 39 is a schematic plan view of angle plate engaged with attachment element with straight edge guide pivoted to an angle.

In FIG. 35 there is shown a straight edge guide element 7 engaged with a fixing point element 45 set on the end of a worktop section, the said straight edge traversing a workpiece as guidance for a circular saw 46. Fixing point element 45 is attached to the end of a worktop section, by insertion into the channels for example, element 48 which disposes an axis hole is inserted into the end of the straight edge guide and an angle plate 47 with axis projection is inserted into element 48. The straight edge guide with attached angle plate is slid across the workpiece to engage with the fixing point. FIG. 38 shows the position before engagement, FIG. 39 after engagement. Ribbed section on the fixing point may permit the angle plate to engage at a number of vertically indexed points if fed in from a horizontal plane but prevents the said angle plate from rising up vertically. A clamp sliding in a channel on the underside of the straight edge guide may clamp the said guide to the worktop section at the other end, as indicated by position 49 in FIG. 75 or to the workpiece if it overlaps the end of the worktop section.

The vertical clamping element 29 may be positioned and fixed in the channel of another worktop section to align a workpiece with the point at which it is pushed up against the fixing point element. The straight edge guide may be angled s shown in FIG. 39.

Figure 40:
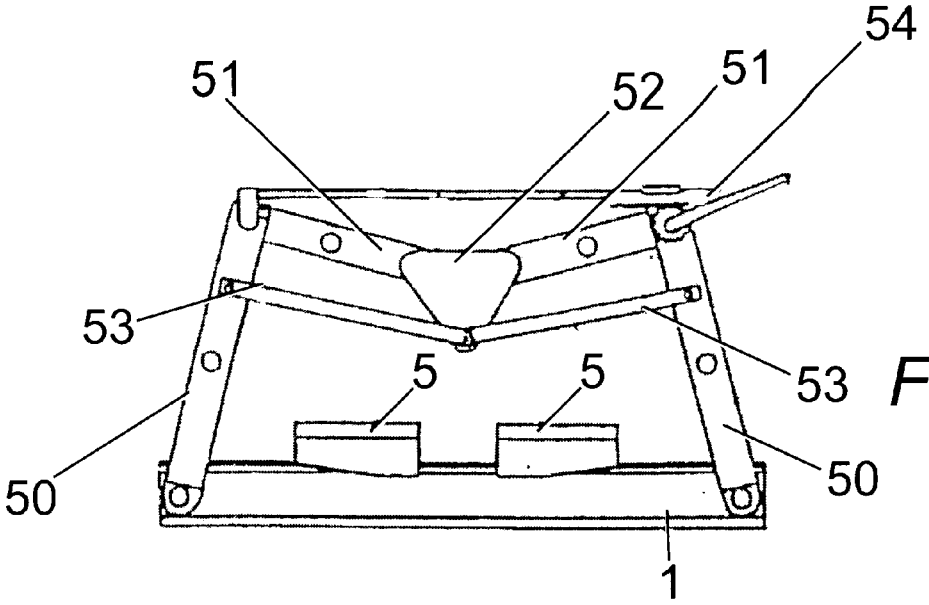
FIG. 40 is a side view of an articulated tool support mounted to a top frame and spanning the jaws.
Figure 49:
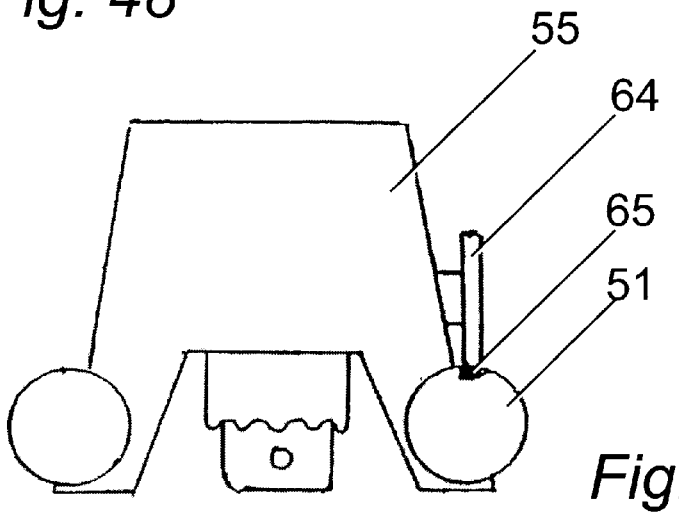
FIG. 49 is a schematic side view of a sliding drill holder with attached recording wheel.

FIGS. 40 and 49 illustrate another aspect of the invention wherein the worktop sections are used to support, clamp and align a workpiece under an articulated tool support and guidance system.

Figure 41:
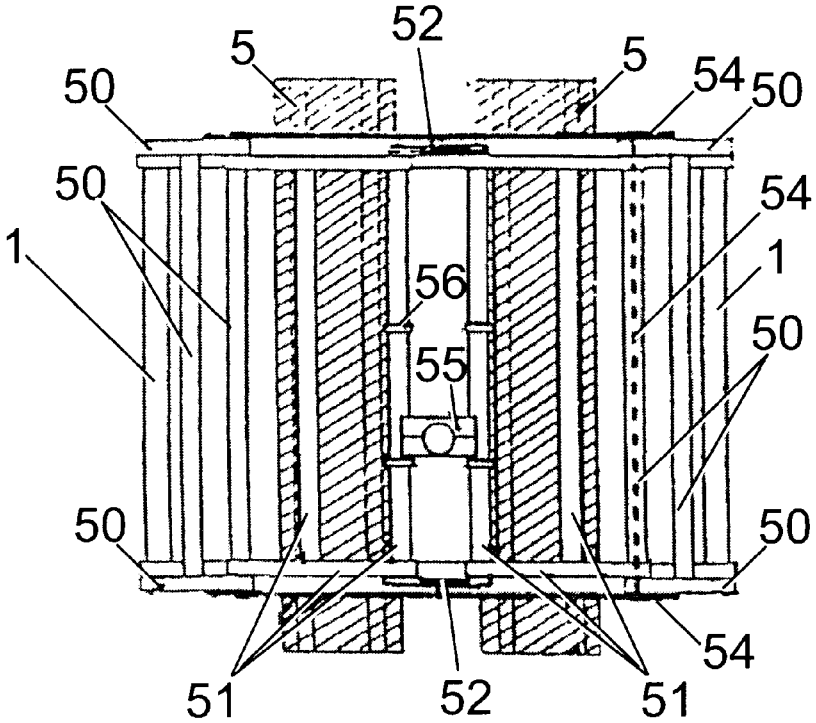
FIG. 41 is a schematic plan view of FIG. 40.

In FIGS. 40 and 41 there is shown an articulated tool support spanning the worktops laterally and comprising two main arm frames 50 one attached to each end of the supporting structure in pivoting relationship, the main arm frames consisting of an arm on each side of the worktable joined by two round section cross-members. Attached to and articulating around the top cross-member of each main arm frame is a secondary arm frame 51 also comprising an arm on each side of the worktable joined by two round section cross-members, the bottom cross-members of the secondary arm frames being joined at each end by a triangular link 52 with which they articulate. The triangular link is joined at a lower mid-point by tertiary arms 53 to a critical point on the main arms above or below which the articulation would block as it descended but at which the triangular points at which the secondary and tertiary arms join the triangular link do not change in relation to each other as the triangle rises or descends thus permitting straightline descent or rising of the system without blocking of the articulation.

The tops of the main arm frames are joined on each side of the worktable by rods which tighten the main arms towards each other the rods being synchronized in their movement by an axel with joined cogged wheels at each end these wheels moving the cogged lengths on the tightening rods 54. Tightening together of the main arms causes the secondary articulated structure to descend.

A holder for a power drill 55 may be fitted to the bottom cross-members of the secondary arm frames and may be slid along it to selected position. This position may be determined with the aid of stop elements 56 which may themselves be slid and locked into position.

Figure 42:
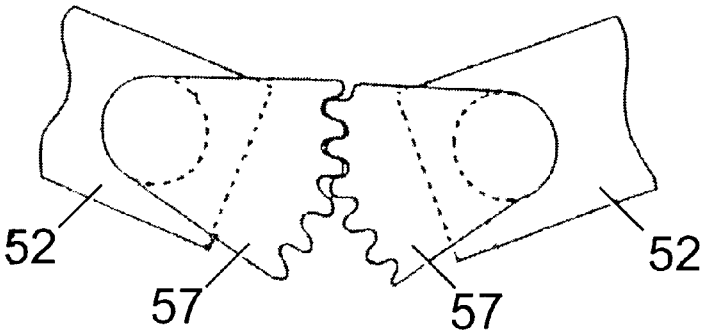
FIG. 42 is a schematic side view of interlocking cogged elements fitted to the secondary arms.
Figure 43:
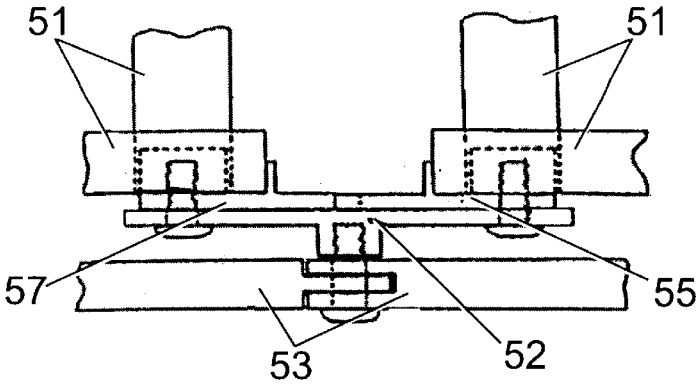
FIG. 43 is a schematic plan view at the point where the cogged elements are joined by the link element and tertiary arms.
Figure 44:
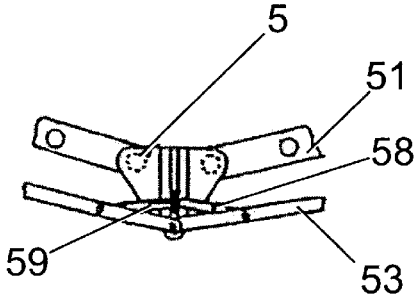
FIG. 44 is a side view of the link element with sliding guide.

FIG. 42 shows interlocking cogged elements 57 fitted into the bottom cross-members of the secondary arm frames the said elements keeping the angle between secondary arm frame and triangular link the same on each side of the articulation. FIG. 43 shows a schematic plan view of the fitted cogged elements, triangular link and tertiary arms at the point where they join the secondary arm frames. In FIG. 44 there is shown another arrangement which may help the straight line vertical descent and rising of the system: two short arms 58 join the tertiary arms to a slide element 59 which runs in a channel on the triangular link element.

Figure 45:
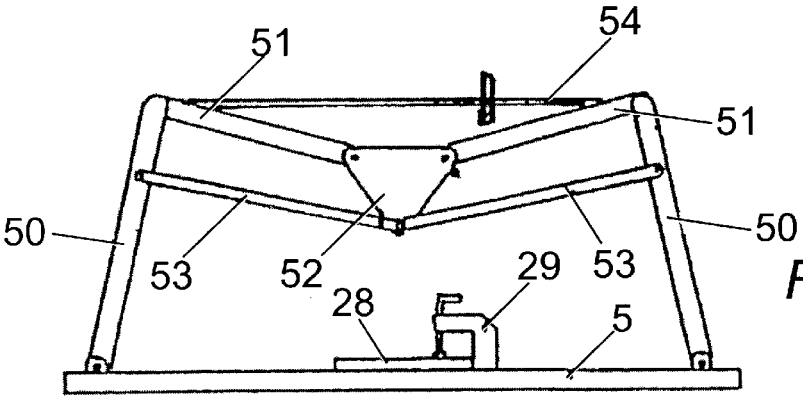
FIG. 45 is a side view of an articulated tool support mounted to a work top section.

In FIG. 45 there is shown a simpler articulated structure without long cross-members, the said structure being mountable on a worktop section or sections spanning a large portion of their length. The articulated structure may hold a drill in a single position for vertical descent without the possibility of horizontal displacement. A workpiece may be aligned and clamped in selected position by vertical clamping elements 29.

Figure 47:
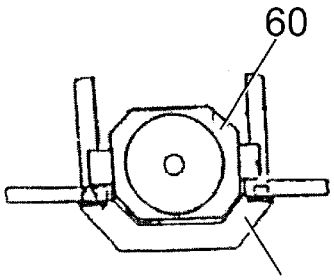
FIG. 47 is a plan view of the link and router plate.
Figure 46:
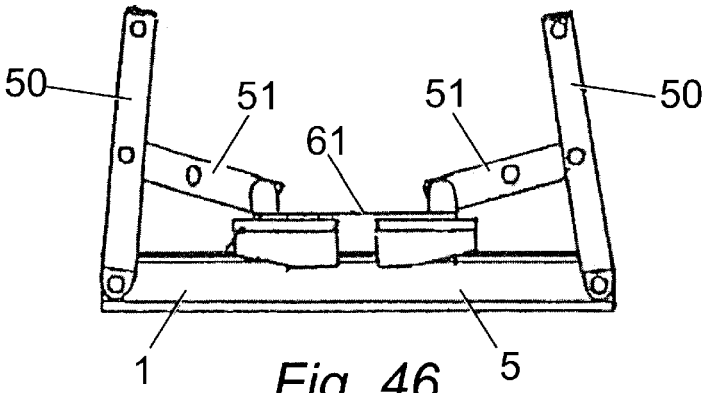
FIG. 46 is a side view of an articulated tool support arranged for the guidance of a router plate.

In FIGS. 46 and 47 there is shown an articulated tool support/guidance system arranged in an alternative way to guide a plate for holding a router 60 along the bottom cross-members of the secondary arm frame, the cross-members being held further apart than in the drilling function by a wider link element 61.

Figure 48:
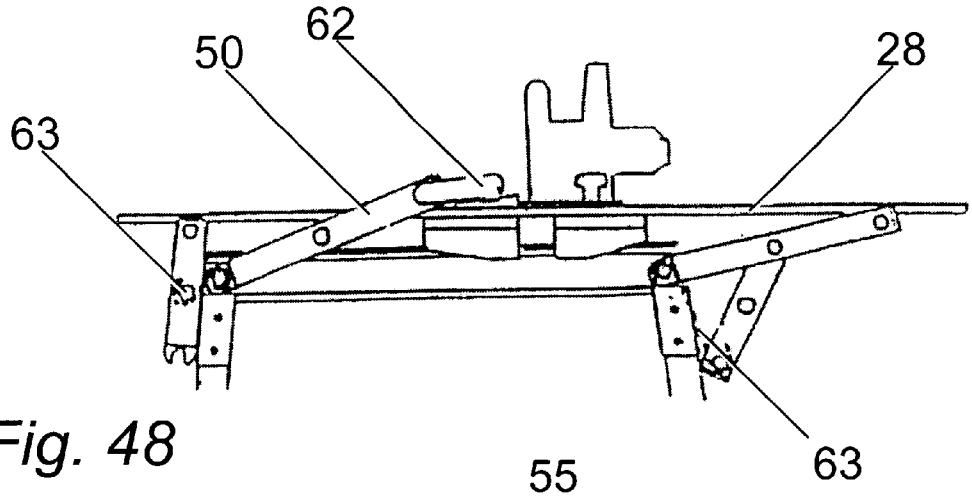
FIG. 48 is a schematic side view of the articulated tool support set for the guidance of a circular saw.

In FIG. 48 there is shown a main arm frame linked to and articulating with a narrow straight edge guide 62 for circular saw or router, the other components being arranged by means of "S" hooks 63 to form extension support for a workpiece.

In FIG. 49 there is shown a recording wheel 64 attached to a drill holder the said wheel running in a track 65 along a lower cross-member of a secondary arm frame, the wheel and the track may be cogged to provide more accurate non-slip recording by the wheel. The recording wheel, which can alternatively be attached to a power drill providing means for that attachment may measure distance between drilling points or if attached to a router the length of a routed channel or slot, the measurement being displayed by the known means of a connected counter or digital read-out.

In FIGS. 50 to 58 another aspect of the invention is illustrated, that of extensions to the worktable supporting structure to permit the easy handling of the large workpieces that may be machined on it.

Figure 50:
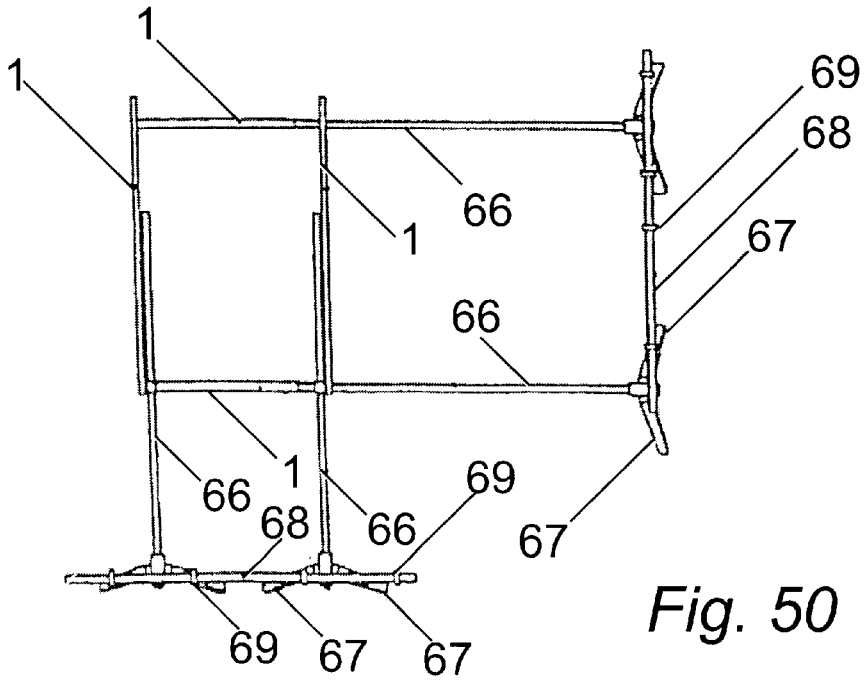
FIG. 50 is a plan view of extension pieces added to the top frame.
Figure 56:
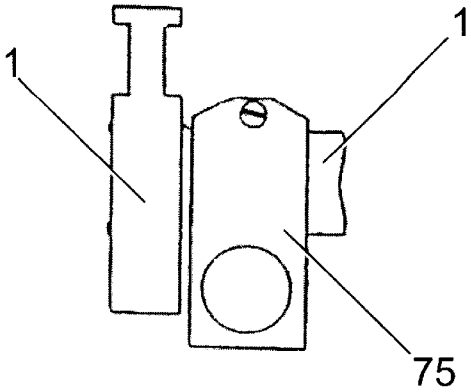
FIG. 56 is a side view of an attachment point for extension rods added to the end of the table.

In FIG. 50 there is shown a plan view of a top frame structure of a worktable to which tubular extension pieces 66 have been added, the said pieces being adjustably nested within the volume of the worktable to suitably position the distal work support end, the extension pieces added to the width of the worktable being inserted into the tubular cross-members of the top frame and those added to the length being inserted into elements 75 which are attached to a top frame cross-member as shown in FIG. 56.

At the distal end of each extension piece there is a leg support 67 comprising two leg members mounted on a double axis, the one which permits the leg members to fold outwards and be braced apart, the other which permits them when folded together also to be folded up to the extension piece for compact carrying. The extension pieces are joined by tubular cross-members 68 around which the wheels adjustably positioned by sliding.

Figure 51:
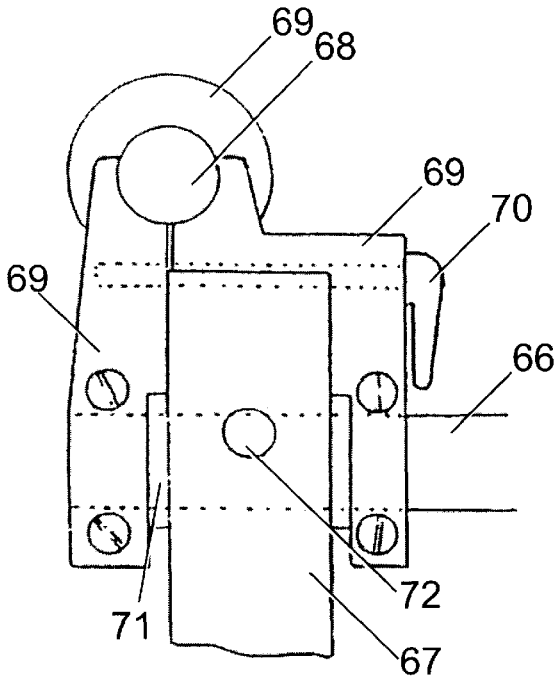
FIG. 51 is a schematic side view of the element which joins extension rod, leg support and cross-member.
Figure 52:
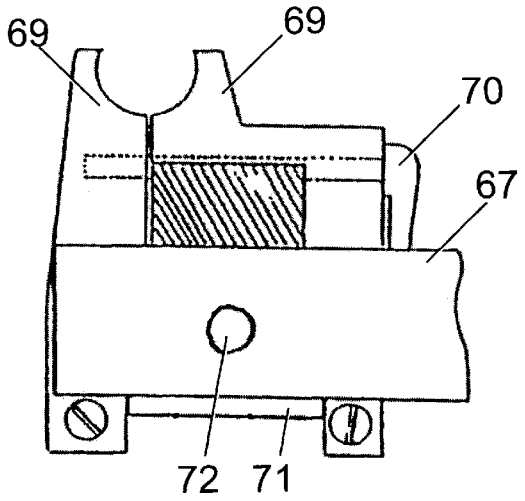
FIG. 52 is a schematic side view of the element in FIG. 51 but with the leg folded and the cross-member removed.
Figure 53:
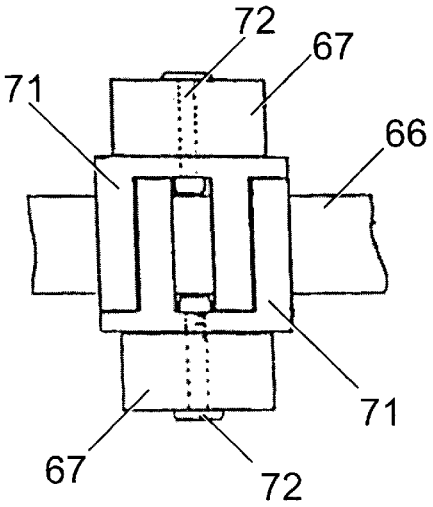
FIG. 53 is a schematic plan view of the swivel attachment of the leg support to the extension rod.

In FIGS. 51 to 53 the details of the elements joining an extension piece, leg support and cross member are shown. FIG. 53 is a plan view of a double axis arrangement for joining a leg support to an extension piece: the leg members are joined by an axis 72 to an element 71 which may partially rotate around the extension piece to allow the leg members to be braced apart. In FIG. 51 the leg support is shown in open position the tops of the leg members being indented into a recess of a two part clamp element 69 which may be tightened together by a lever 70 attached to a threaded element joining the two parts. The clamp element also clamps the cross-member in place. In FIG. 52 the leg support is shown pivoted back around axis 72 revealing the recess in the clamp element.

Figure 54:
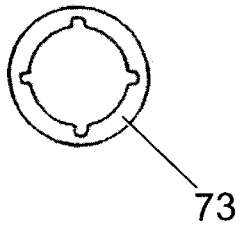
FIG. 54 is a side view of a plug insert.
Figure 55:
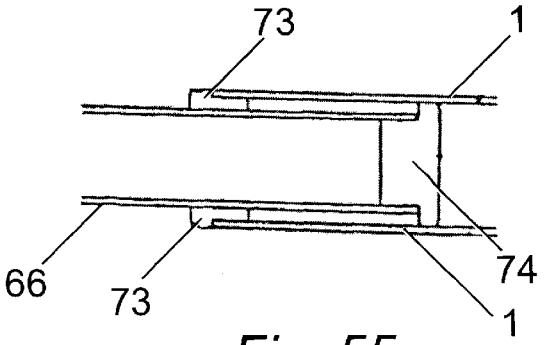
FIG. 55 is a schematic cross-section view of tubular top frame cross-member with plug insert and nesting extension rod.

In FIG. 54 there is shown a side view of a plug which may be partially inserted into the cross-members of the top frame and/or of the leg supports of the worktable, FIG. 55 showing a schematic cross-section view of an extension piece inserted, element 74 at the end of the extension piece having four lateral projections which may pass through the form of the plug insert, touching the inner wall of the cross-member such that the inserted extension piece is held without free-play. Extension pieces may be inserted into the bottom cross-members of the leg supports to give extendable feet which may add to the stability of the worktable.

Figure 57:
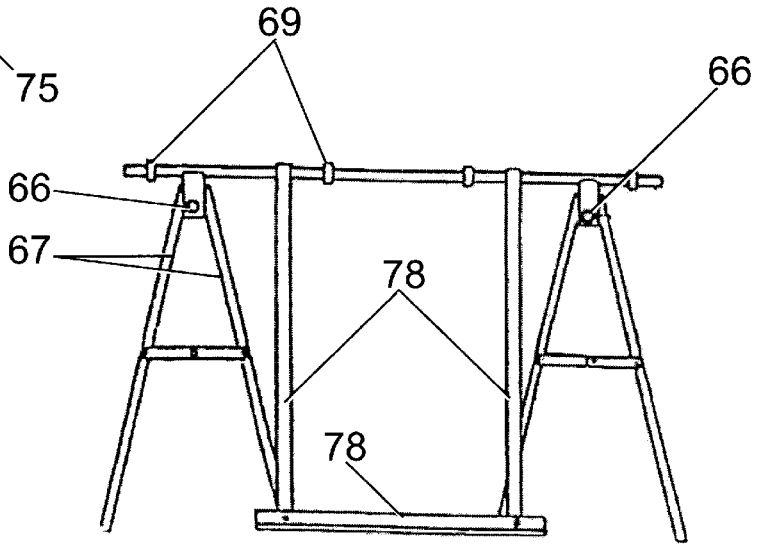
FIG. 57 is an end view of the extension rods with their leg supports with panel loader attached to the cross-member.
Figure 58:
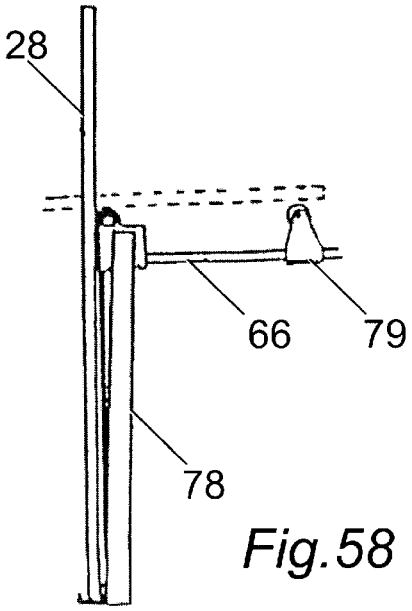
FIG. 58 is a side view of the extension showing panel loader with panel.

In FIG. 57 there is shown an end view of two extension pieces with their leg supports and a panel loader 78 which is attached to the extension cross-member. In FIG. 58 there is shown a side view of a panel on the loader the loader being rotatable around its attachment points such that the panel may be pivoted to a horizontal plane on the extensions as indicated by dotted line A. Further supports 79 may be added to the extension system. A panel loader may also be attached to and rotate about a cross-member of a top frame.

I claim:

1. A worktable system comprising a supporting structure, at least two worktop sections each of which is freely displaceable along the supporting structure, said worktop sections including first and second worktop sections having edges cooperating to form jaws of a workpiece clamp, at least one of said first and second worktop sections having mounted thereon for movement therewith clamping means operable to releasably clamp said at least one of said first and second worktop sections to said supporting structure at a selected location, said at least one of said first and second worktop sections further being provided with tightening means movable with said worktop section and operable, when said worktop section is clamped in a desired location, to tighten said worktop section forwardly towards another worktop section.

2. A worktable section according to claim 1, in which said clamping means is unlocked by pivoting said at least one worktop section into an inclined position relative to said supporting structure, and is locked by pivoting said at least one worktop section into alignment with said supporting structure.

3. A worktable system according to claim 1, in which at least one of said first and second worktop sections is provided with a guide channel which permits one or more functional elements to be mounted on and positionally adjusted on the respective worktop section.

4. A worktable system according to claim 3, in which said functional element is a clamping member provided with tightening means for locking the clamping member in the guide channel.

5. A worktable system comprising a supporting structure, and first and second worktop sections mounted on the supporting structure, said first and second worktop sections having edges cooperating to form jaws of a clamp, and at least one of said first and second worktop sections being provided with a guide channel which permits one or more functional elements to be mounted on and positionally adjusted on the respective worktop section.

6. A worktable system according to claim 1 or claim 5, including a third worktop section displaceable along said supporting structure at a level below said first and second worktop sections.

7. A worktable system according to claim 1 or claim 5, in which said first worktop section is provided with means for mounting a power tool.

8. A worktable system according to claim 7, in which said power tool mounting means comprises means for guiding a power tool for movement relative to said first worktop section.

9. A worktable system according to claim 7, in which said power tool mounting means comprises means for securing a power tool in a fixed position on said first worktop section is provided with guide means for guiding movement of a workpiece to the power tool, said guide means being selectively positionable on said second worktop section.

10. A worktable system according to claim 9, in which said guide means is arranged to feed said workpiece to said power tool in a first direction, and said first worktop section carrying said power tool is moveable on said supporting structure in a second direction perpendicular to said first direction.

11. A worktable system according to claim 8, in which said power tool guiding means comprises a fixing means releasably attachable to said first worktop section and a straight edge guide removably received in said fixing means, and in which said second worktop section has releasably attached thereto a clamping element for clamping and aligning said workpiece.

12. A worktable system according to claim 1 or claim 5, including a power tool support removably mounted on said first worktop section, said power tool support comprising an articulated mechanism spanning said first worktop section and movable together with the power tool toward and away from said first worktop section.

13. A worktable system according to claim 12, in which the power tool is mounted for sliding movement along said power tool support.

14. A worktable system according to claim 13, including a distance measuring device arranged to measure the distance travelled by the power tool along said power tool support.

15. A worktable system comprising a supporting structure and at least two worktop sections adjustably mounted on the supporting structure; and in which the supporting structure comprises a generally box-shaped upper portion and first and second leg assemblies pivotally connected to said upper portion adjacent opposite ends thereof, at least one of said leg assemblies being offset from its pivot axis such that said leg assemblies may be moved between an open position in which said leg assemblies support said upper portion at an operational height and a closed position in which said leg assemblies are nested within said upper portion and lie one above the other.

16. A worktable system according to claim 15, in which said upper portion comprises a top frame including at least one cross-member to which one of said leg assemblies is rotationally mounted.

17. A worktable system according to claim 16, including a strut element extending between said leg assemblies in said open position.

18. A worktable system according to claim 15, in which said worktop sections are removable from said supporting structure and are dimensioned to be receivable within said upper portion when in said closed position.

19. A worktable system according to claim 15, further comprising a worktop extension piece nested within said upper portion and adjustably extendable therefrom.

20. A worktable system according to claim 19, in which said extension piece is provided with support legs at an outer end thereof, said support legs comprising a pair of legs pivoted to a member which in turn is pivotally mounted on the extension piece.

21. A worktable system comprising a supporting structure, at least two worktop sections adjustably mounted on the supporting structure, and a panel loading device which comprises a planar support having one end secured relative to said supporting structure for pivotal movement about a horizontal axis and an outer end provided with panel-locating stop means.

22. A worktable system according to claim 21, in which a worktop extension piece is selectively mounted on said supporting structure, and said panel loading device is selectively securable to said supporting structure and to said worktop extension piece.

* * * * *